United States Patent [19]

Nagelkirk

[11] 3,990,166

[45] Nov. 9, 1976

[54] ILLUMINATED DISPLAY APPARATUS HAVING SPRING ACTUATED SWITCH

[76] Inventor: Dale G. Nagelkirk, 10327 W. Calle de Edens, Phoenix, Ariz. 85039

[22] Filed: Feb. 12, 1976

[21] Appl. No.: 657,362

Related U.S. Application Data

[63] Continuation-in-part of Ser. No. 420,623, Nov. 30, 1973, abandoned.

[52] U.S. Cl. ..... 40/77; 40/132 D; 40/152.2; 200/61.58 R; 200/153 L; 200/155 R

[51] Int. Cl.[2] ..... G09F 11/02

[58] Field of Search ..... 40/33, 40, 57, 63 A, 40/61 R, 64 A, 70 A, 77, 52 R, 68, 106.1, 130 R, 130 L, 152.2; 46/228, 230; 200/61.5 BR, 153 L, 155 R; 240/10 R, 10.1; 274/14; 340/338; 273/155

[56] References Cited

UNITED STATES PATENTS

| | | | |
|---|---|---|---|
| 1,612,662 | 12/1926 | Stillwell | 40/32 |
| 1,812,715 | 6/1931 | Quillin et al. | 40/32 |
| 1,942,073 | 1/1934 | Teichmann | 40/77 |
| 2,526,514 | 10/1950 | Stadtmiller | 40/77 |
| 2,720,137 | 10/1955 | Museback et al. | 40/32 X |
| 3,811,041 | 5/1974 | Matsushita | 240/10 R X |

FOREIGN PATENTS OR APPLICATIONS

| | | | |
|---|---|---|---|
| 1,283,722 | 11/1968 | Germany | 46/230 |

*Primary Examiner*—Richard C. Pinkham
*Assistant Examiner*—Vance Y. Hum
*Attorney, Agent, or Firm*—H. Gordon Shields

[57] ABSTRACT

Apparatus is disclosed which includes a switch actuated illumination device for scenic or advertising display by either rotating the apparatus on a base or by lifting the apparatus off the base to actuate the switch.

10 Claims, 18 Drawing Figures

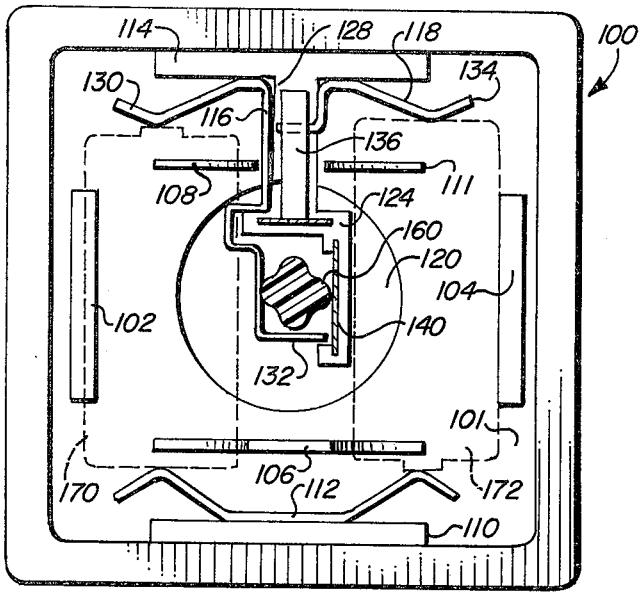
Fig-7
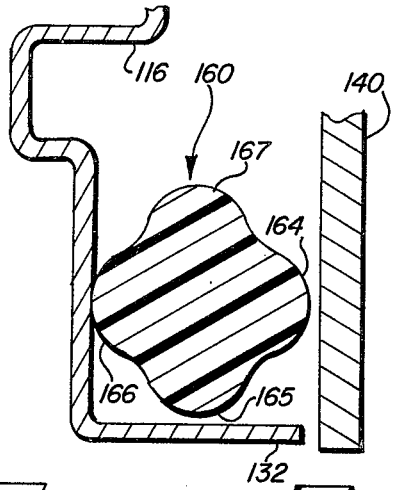
Fig-8
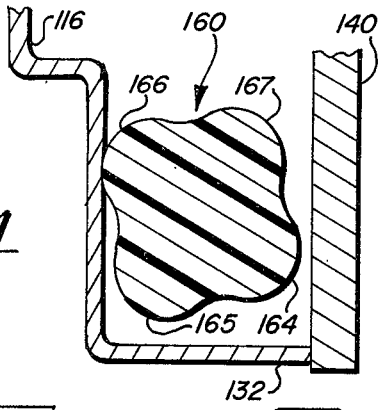
Fig-9
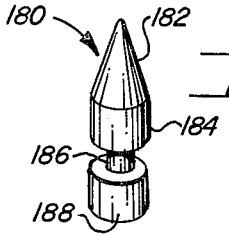
Fig-11
Fig-10
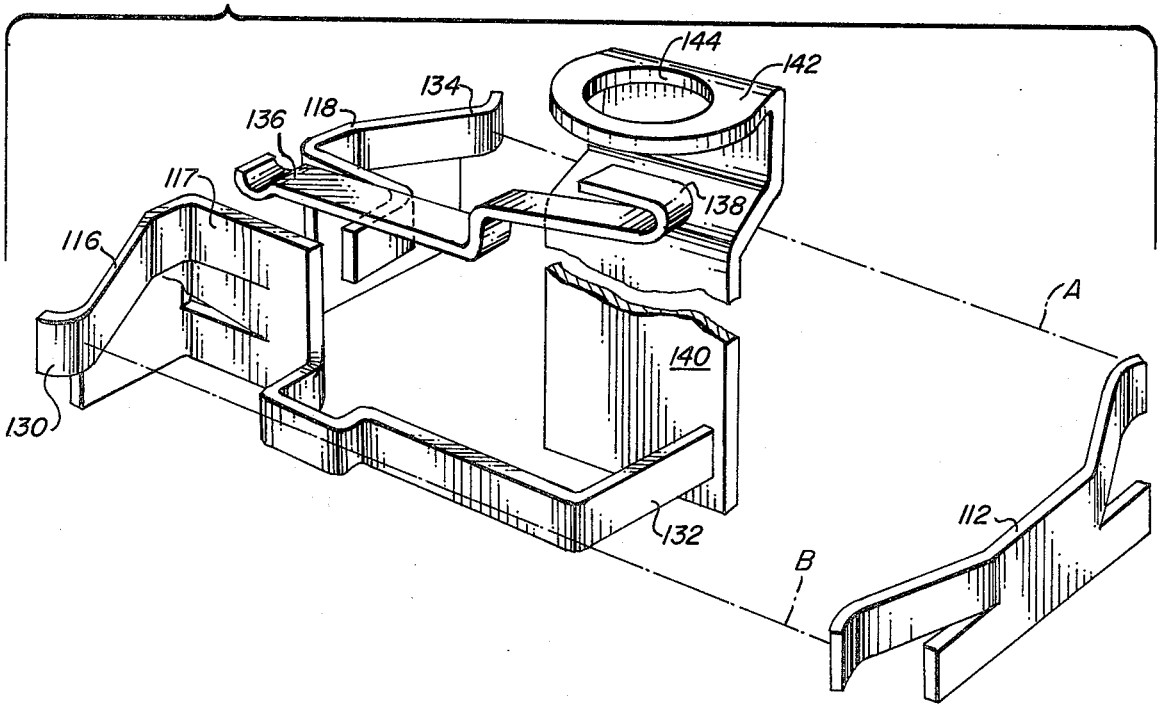

ILLUMINATED DISPLAY APPARATUS HAVING SPRING ACTUATED SWITCH

CROSS-REFERENCE TO RELATED APPLICATION

This application is a continuation-in-part of Ser. No. 420,623, filed Nov. 30, 1973, now abandoned.

BACKGROUND OF THE INVENTION

1. Field of the Invention.

This invention relates to display devices, and more particularly, to illuminated display devices. The display device includes a switch actuated illuminating or light producing means which is actuated when the apparatus is oriented or placed in certain positions with respect to the switch.

2. Description of the Prior Art.

Advertising and other novelty display apparatus of various types have been well known in the art. However, the prior art display items require a switching means of some type, generally manually operated, in order to illuminate the apparatus and also to turn the illumination off. Such apparatus are typically used for advertising purposes, for the display of scenic pictures, such as slides, and for signaling devices, such as to call a waiter or to direct the attention of an individual to the particular setting of environment in which the apparatus is used. Another use of apparatus of that type is also found in a home or in an office where pictures or scenes may be displayed, and such display is enhanced by the illumination thereof from a central or interior source. For example, viewing or display cubes having pictures on five or six of the sides are used in many homes to display pictures of the family or to display scenes familiar and enjoyable to family members. Such cubes may also be used in an office environment to display either personal items or business slogans, information, and the like. In the prior art, the illumination means disposed within such cube or other apparatus is generally battery operated and requires some type of manual switch for illumination. The type of switch typical of such prior art devices is a manually operated switch located somewhere on the cube, or on the base of the device.

SUMMARY OF THE INVENTION

The invention disclosed and claimed herein includes display apparatus which is operable with respect to central interior illumination according to the attitude or position of the apparatus. The apparatus may be rotated on its base to actuate the switch or it may be lifted on its base to actuate the switch.

Among the objects of the present invention are the following:

- To provide new and useful display apparatus;
- To provide new and useful display apparatus including switch actuated illumination means;
- To provide new and useful display apparatus actuable by orientation of the apparatus;
- To provide new and useful display apparatus rotatable on a base; and
- To provide new and useful illuminated apparatus including a self-contained switch actuable according to the orientation of the apparatus.

BRIEF DESCRIPTION OF THE DRAWING

FIG. 7 is a plan view taken generally along line 7—7 of FIG. 5.

FIGS. 8 and 9 are enlarged sequential views of a portion of the apparatus of FIG. 7.

FIG. 10 is a schematic representation of the electrical conductors of the apparatus of FIG. 5.

FIG. 11 is an isometric drawing of an alternate embodiment of a portion of the apparatus of FIG. 5.

DESCRIPTION OF THE PREFERRED EMBODIMENT

Figure 1:
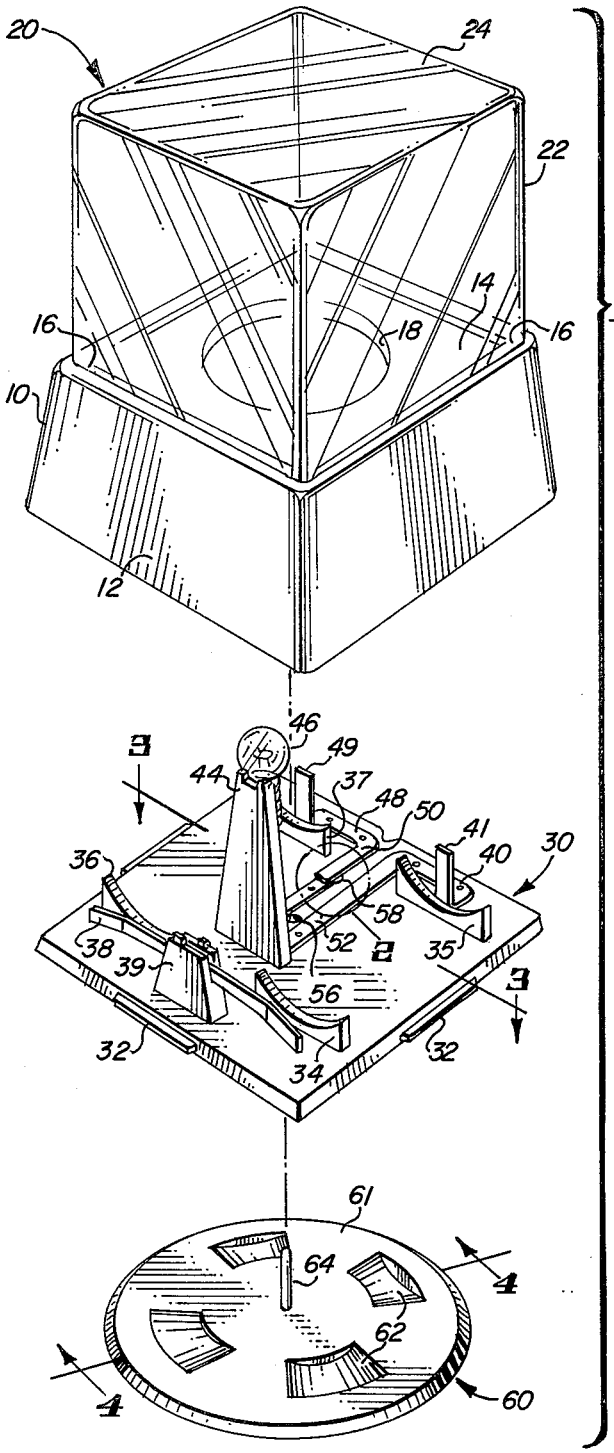
FIG. 1 is an exploded isometric view of apparatus embodying the present invention.

FIG. 1 is an exploded isometric view of apparatus embodying the present invention, including the major portions thereof. The Figure is separated into three different portions of the apparatus, the top one including a pedestal 10 with a viewing cube or viewing case 20 disclosed thereon. Underneath the pedestal and viewing case is a platform base 30, which includes the electrical circuitry and switch for the apparatus. Beneath the platform base is a rotal base 60 on which the platform base is disposed and to which it is secured for limited rotary movement. The limitation of movement of the platform base on the rotal base is for convenience in rotating the platform base, pedestal, and viewing case, as the three are secured together, to actuate the switch apparatus which will result in either the illumination of the viewing case or the reverse of such illumination, depending on the location of the platform base on the rotal base, as will be explained in detail below.

Figure 5:
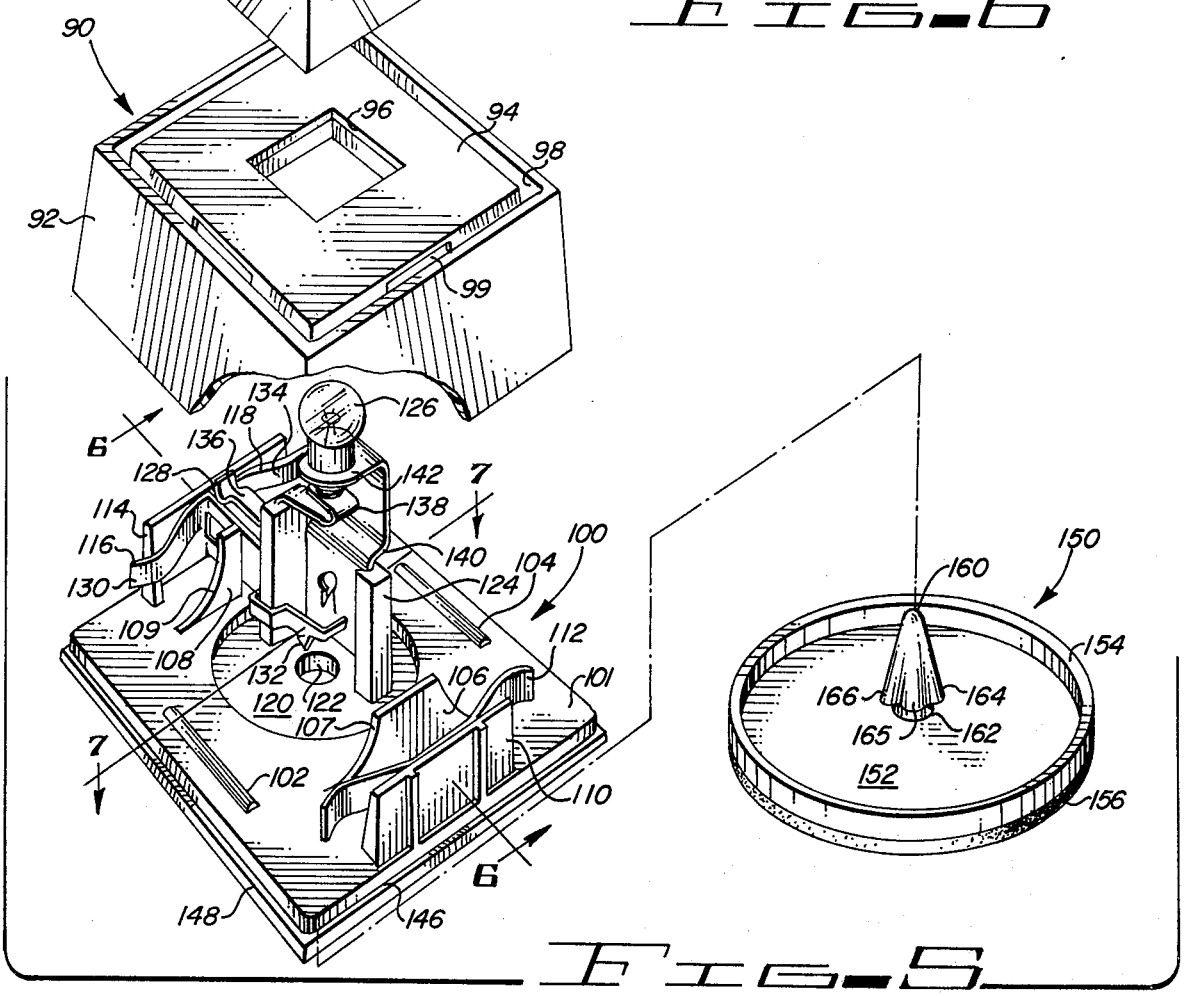
FIG. 5 is an exploded isometric view of an alternate embodiment of the apparatus of FIG. 1.

The viewing case or viewing cube is a generally transparent hollow cube, with only five of its six sides being solid. It is thus a hollow cube with four sides and a top, and with the bottom side open to allow the implacement of colored slides, transparencies, or other desired informative or decorative material to be disposed on the inside of the viewing case. The bottom edges of the viewing case mate with the pedestal to hold the viewing case thereon. A light diffuser for the inside of the viewing case has been omitted from FIG. 1, but it is shown in FIG. 5.

The pedestal 10 is of a frusto-pyramidal configuration, with four upwardly and inwardly tapering walls 12. The taper is slight, and the overall height of the pedestal is only about half that of the viewing case or cube. Recessed slightly below the top of the inner portion of the walls 12 is a support plate 14. Extending around the support plate and spaced slightly inwardly from the perimeter is a recess 16. The recess serves to hold the viewing case to the pedestal.

Centrally disposed with respect to the support plate 14 is an aperture 18 which extends therethrough. The aperture cooperates with the platform base 30 to allow illumination means disposed on the platform base to extend onto the interior of the viewing case to illuminate the material within the viewing case.

The viewing cube or viewing case includes four sides 22 and a top 24, all of which are substantially the same size and are transparent to allow the display material disposed therein against the sides and against the top to be viewed by observers. The illumination of transparencies, such as slides or otherwise, from within the viewing case is obtained by rotating the platform base, pedestal, and viewing case on the rotal base. The platform base 30 is thus secured to the pedestal and functions therewith.

The platform base is rectangularly configured and dimensioned to fit within the bottom or lower portion of the pedestal 10. Tabs 32 extend outwardly from each side of the platform base 30 and engage with matching grooves within the lower portion of pedestal 10. The tabs 32 comprise locking members to secure the platform base and the pedestal together.

Disposed on the platform base 30 are two pairs of cradles which support a pair of batteries. The first pair of cradles, cradles 34 and 35, are parallel to each other and are curved to fit the circular configuration of a standard battery. The second pair of cradles, cradles 36 and 37, are also parallel to each other and are aligned with the first pair of cradles 34 and 35. Cradles 36 and 37 are also curved to fit the cylindrical configuration of a standard battery. To provide electrical connections between the pair of batteries, not shown, which would be disposed on the cradles, is a conductor 38. The conductor is supported by a post 39 which is also disposed on the platform base 30. The conductor is preferably made of an appropriate conductive metal which includes spring tempering to provide the necessary bias against the batteries to insure good electrical connections therewith. The post 39 is situated adjacent cradles 34 and 36.

Adjacent cradles 35 and 37 are other conductors which make contact with the opposite ends of the batteries from conductor 38. Adjacent cradle 35 is a conductor strip 40, which is secured to the platform base 30. The conductor 40 includes a vertical portion 41 extending upwardly from the platform base 30 adjacent the cradle 35. The vertical portion 41 is designed to make contact with the battery disposed in cradles 34 and 35. Adjacent the vertical portion 41, the conductor 40 is secured to the platform base 30 and it extends to a pylon 44 which is supported on the base 30 between the parallel cradle pairs 34, 35 and 36, 37, and towards support post 39 from the center of the platform base. That is, the pylon 44 is slightly off center and disposed between the cradles which support the pair of batteries. The purpose of the pylon is to support a lamp 46 and the electrical conductors associated therewith, within the cube or viewing case 20. Accordingly, the pylon 44 extends upwardly from the platform base 30 and, when assembled with the cube or viewing case and the pedestal, the pylon extends through aperture 18 of support plate 14. To make the necessary electrical connections with lamp 46, the conductor 40 includes a vertically extended portion 42 (see FIG. 3) which is disposed against and secured to pylon 44 to make contact with lamp 46. The conductor 40 is secured to platform base 30 by protuberances from the base 30 extending through holes or apertures in the conductor and by applying heat to melt the protuberances and thereby to hold the conductor against the base 30.

Figure 2:
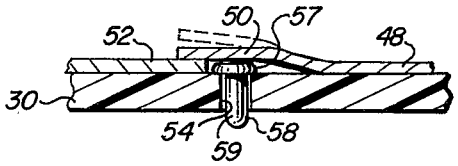
FIG. 2 is a view of a portion of the apparatus of FIG. 1.

Adjacent cradle 37, opposite cradle 35 and conductor 40, is a conductor 48 which makes contact with the battery disposed in cradles 36 and 37. The conductor 48 includes a vertical portion 49 which is substantially the same as, and parallel to, the vertical portion 41 of conductor 40. The conductor 48 is secured to the base 30 in substantially the same manner as in conductor 40. The conductor 48 includes a spring portion 50 which is disposed above an aperture in the platform base 30. The spring portion 50 of the conductor makes and breaks the electrical circuit to turn on and turn off the lamp 46 according to the position of the platform base 30 on the rotal base 60, as will be described in detail below. The spring portion 50 of the conductor terminates slightly beyond the aperture in the plate, as is best illustrated in FIG. 2. A conductor 52 is secured to platform base 30 in substantially the same manner as conductors 40 and 48, and is disposed parallel to the spring contact portion 50 of conductor 48. The conductor 52 extends from adjacent the aperture in platform base 30 and underlies a part of the spring contact 50 so as to make electrical contact therewith under certain circumstances. A pin 58 is disposed in the aperture beneath contact 50. In the opposite direction the conductor 52 extends to the pylon 44 and it also includes a vertical portion 53 (see FIG. 3) which is secured to the pylon 44 and makes contact with lamp 46 for a completion of the electrical circuitry to the lamp, providing the spring contact portion 50 of conductor 48 is in electrical contact with conductor 52.

A pivot hole 56 is located centrally on platform base 30. The pivot hole is an aperture which extends through the base and it comprises a hole about which the platform base, with the pedestal and cube or viewing case secured thereto, pivots on the rotal base 60. As will be explained in detail below, the pivoting of the platform base on the rotal base makes and breaks electrical contact between the spring contact 50 and the conductor 52.

The rotal base 60 is disposed beneath the platform base 30 and provides both support for the platform base, with the pedestal and cube secured thereto, and in cooperation with elements on the platform base, a switching function. The rotal base is generally circular in configuration and is of sufficient thickness to include a plurality of depressions 62 which extend downwardly from a top surface 61 of the base 60. The depressions 62 are spaced apart from each other at a predetermined radius from a pivot pin 64 which is located in the center of the rotal base 60 and extends vertically therefrom. When the platform base 30 is positioned on the rotal base 60, the pivot pin 64 extends through aperture 56 in the platform base and accordingly the platform base pivots about the pin 64 and the aperture 56. The depressions 62 are located at a radial distance from the pivot pin 64 equal to the distance between the pivot hole 56 and the aperture in the base 30 through which the pin 58 extends. The pin 58 is disposed beneath the spring contact portion 50 of the conductor 48 to make and break contact between the contact 50 and the conductor 52 to make and break the electrical circuit. The pin extends downwardly through platform base 30 into the depressions 62 as the platform base is pivoted about pivot pin 64 on the rotal base 60. When the pin extends down into a depression, the spring contact 50 is allowed to make electrical contact with the conductor 52 to close the circuit. When the platform base is moved so that the pin 58 is disposed on the top surface 61 of the platform base 60 and out of a depression 62, the pin moves the spring contact 50 upwardly away from conductor 52 and thus breaks the circuit. As illustrated, four depressions are spaced apart substantially equally on the rotal base 60.

FIG. 2 is an enlarged fragmentary view in partial section of FIG. 1 designated by the circle 2 in FIG. 1. The relationship between the platform base 30, conductors 48 and 50 and pin 58 is shown. The pin 58 extends through an aperture 54 and the platform base 30. Conductor 52 is disposed on, and secured to, the platform base 30 adjacent the aperture 54. Conductor 48 is also disposed on and secured to the platform base 30. Conductor 48 extends toward the aperture 54, where it terminates in a spring contact portion 50 overlying both the aperture 54, with the pin 58 disposed therein, and the conductor 52.

The pin 58 includes a head portion 57 and a shaft portion 59. The head portion 57 is less in thickness than the thickness of the conductors 48 and 52 and greater in diameter than the aperture 54. Thus the head 57 prevents the pin 58 from falling through the aperture 54 and allows the pin to be supported on the platform base 30. The shaft 59 of the pin 58 is longer than the thickness of the platform base 30. Accordingly, when the platform base 30 is moved on rotal base 60 such that the shaft 59 of the pin 58 is disposed on the top surface 61 of the rotal base (see FIG. 1) the head 57 of the pin raises the spring contact portion 50 of the conductor 48 out of electrical contact with conductor 52 to the position shown by dotted lines in FIG. 2. When the platform base 30 has been rotated so as to allow the shaft 59 to extend into a depression 62 on the rotal base, the spring contact 50 moves downwardly to make electrical contact with the conductor 54, as illustrated in FIG. 2 in solid lines. In this position, the spring contact 50 is not touching the head 57 of the pin 58.

In the manner above described, the electrical circuitry is operated so as to illuminate the lamp 46 and accordingly the cube 20 as desired by merely rotating the platform base, with the pedestal and the cube secured thereto, on the rotal base. The pin 58 and spring contact 50 comprise a switch, in cooperation with the depressions and the top surface of the rotal base to make and break electrical contact between conductors 48 and 52.

Referring again to FIG. 1, it will be noted that the depressions are "scooped" out of, or rather into, the rotal base 60 such that the bottom of the depressions are smoothly concave with respect to the top surface 61 of the rotal base. That is, each depression extends smoothly from the top surface 61 of the base downwardly to a maximum depth in about the center of each of the respective depressions and then moves again smoothly upwardly to the top surface 61 so as to provide a smooth interior concave camming surface for the pin 58.

Figure 3:
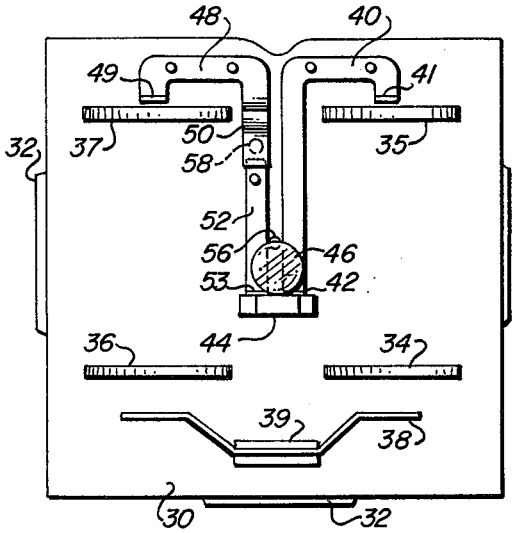
FIG. 3 is a view of a portion of the apparatus of FIG. 1 taken generally along line 3—3 thereof.

FIG. 3 is a plan view of the platform base 30 of FIG. 1, substantially as indicated in FIG. 1 by lines 3-3. The platform base 30 is shown, with tabs 32 extending from three sides of the base. The cradles 34, 35, and 36, 37 are shown disposed on the platform base 30 substantially in parallel alignment with respect to each other. At one end of the generally square base 30 is support post 39, with conductor 38 extending therefrom adjacent the cradles 34 and 36, and positioned so as to make electrical contact with batteries supported by the respective cradles. Pivot hole 56 is located in substantially the center of the platform base. As indicated above, the platform base pivots about the pivot hole 56 on the rotal base 60. Spaces apart from the pivot hole 56 a short distance is pylon 44. The pylon 44 supports a lamp 46 which provides illumination for the interior of the cube or viewing case 20 (see FIG. 1) when the unit is assembled together and appropriate electrical contact is made with the various portions of the circuitry. Adjacent cradle 35 and disposed in the top surface of base 30 is a conductor 40, with a vertical portion 41 of the conductor disposed so as to make electrical contact with a battery supported by cradles 34 and 35. The conductor 40 extends from the vertical portion 41 to another vertical portion 42 which is secured to pylon 44.

Another conductor 48 is disposed on the top surface of platform base 30 for making electrical contact with a battery disposed in cradles 36, 37. The conductor 48 includes a vertical portion 49 disposed adjacent the cradle 37. The conductor 48 terminates in a spring contact portion 50 remote from the vertical portion 49 and adjacent and overlying both the pin 58 and a portion of conductor 52. The conductor 52 extends from beneath spring contact portion 50 of conductor 48, which is also adjacent the pin 58, to the pylon 44. The conductor 52 includes a vertically extending portion 53 secured to the pylon 44. Both the vertical portions 42 and 53 of the conductors 40 and 52 provide electrical contact with the appropriate portions of lamp 46 to make an electrical circuit through the lamp as required for the illumination thereof. The purpose of the pin 58 is to provide the switching function of making and breaking electrical connection between contact 50 and conductor 52 according to the position of the pin 58 on rotal base 60 and the depressions 62 (see FIGS. 1 and 4) thereon.

Figure 4:
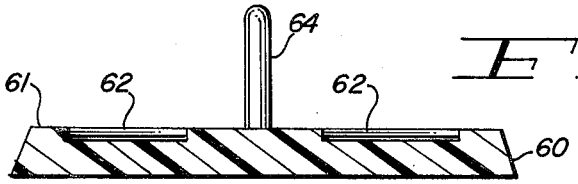
FIG. 4 is a view in partial section of a portion of the apparatus of FIG. 1 taken generally along line 4—4 of FIG. 1.

FIG. 4 is a view in partial section of the rotal base 60 of FIG. 1 taken generally along line 4—4 of FIG. 1. The rotal base 60 is shown with the pivot pin 64 extending substantially vertically from the top surface 61 of the rotal base. A pair of depressions 62 which comprise concave cams, or camming surfaces, are shown extending downwardly into the base from the top surface 61.

When the platform base 30 (see FIG. 1) is assembled to the rotal base 60, with the pivot pin 64 extending through the aperture 56, appropriate heat may be applied to the top of the pin 64 to melt the top portion of the pivot pin and accordingly to flatten the top of the pin to provide a cap larger than the diameter of the aperture 56. This prevents the platform base 30 from being separated from the rotal base 60, but yet still allows the platform base, with the pedestal and the viewing cube secured thereto, as a unit, to rotate freely on the rotal base.

FIG. 5 discloses an alternate embodiment of the apparatus described above in conjunction with FIGS. 1–4. In the embodiment of FIG. 5, the switch apparatus used to connect and to interrupt the electrical circuitry to turn on and turn off a light is integral with the pin about or on which the apparatus rotates.

FIG. 5 includes a viewing case or viewing cube 70, which is substantially the same as the viewing case or cube 20 of FIG. 1, and a diffuser or diffuser cube 80 disposed beneath and within the viewing cube 70. The diffuser cube 80, when assembled, fits inside the viewing cube 70 and serves a dual function of holding slides or transparencies against the interior of the viewing cube, and of diffusing the light produced by a lamp so as to evenly distribute the light to the transparencies or slides. The diffuser cube 80 is hollow, and includes only five sides, as does the viewing cube. The diffuser cube is preferably made of translucent material while the viewing cube is made of transparent material. When the viewing cube and the diffuser cube are assembled, there is a slight space between the five sides of the diffuser and the matching five sides of the viewing cube. This space is occupied by the transparencies.

Beneath the viewing cube and the diffuser cube is a pedestal 90, which is similar to the pedestal 10 of FIG. 1. The pedestal 90 includes four sides 92 which slope slightly inwardly and upwardly in a generally frusto pyramidal configuration. The pedestal also has five sides, is hollow, and is open on the bottom. The upper portion of the pedestal is closed by an upper surface or top 94. An aperture 96, generally square in configuration, extends through the top 94 and serves to admit light producing means, such as a lamp, into the interiors of the diffuser and the viewing cubes to illuminate the interior of the cubes.

On the top of the pedestal, a trough or depression 98 extends about the perimeter of the top 94 adjacent the upper portion of the four sides 92. The trough or depression, which has four sides or elements corresponding to the four sides of the viewing cube and of the pedestal, receives the bottom portions of the diffuser and the viewing cube. Each of the four sides of the trough 98 includes an appropriate elongated protuberance 99 which holds the viewing cube to the pedestal by friction.

Figure 6:
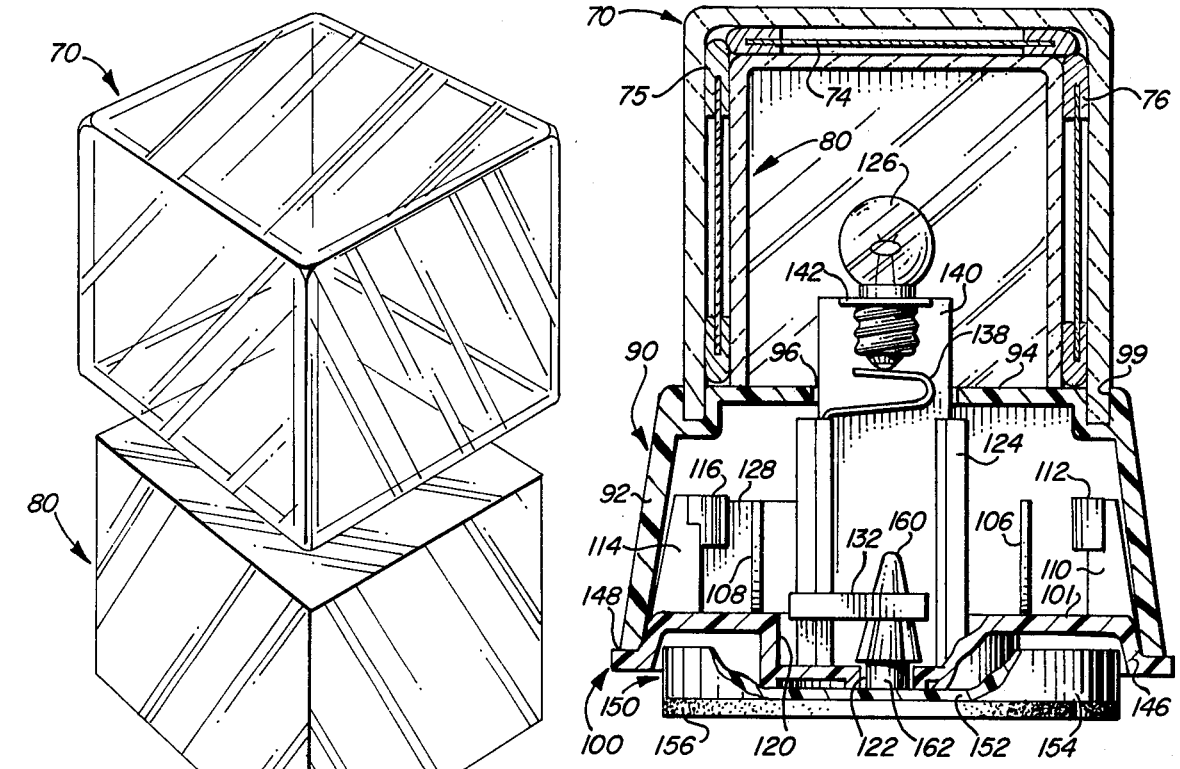
FIG. 6 is a view in partial section taken generally along line 6—6 of FIG. 5.

The pedestal is generally hollow and it receives the electrical components which are disposed on a base 100 and which are shown beneath the pedestal in FIG. 5. The base 100 is generally square in configuration and, when assembled to the pedestal, is secured thereto, as shown in FIG. 6, with the electrical circuitry components disposed within the pedestal 90 and a portion thereof extending through aperture 96 into the interior of both the diffuser and the viewing cube. The base 100 includes a downwardly extending rim 146 along its outer periphery and it also includes a flange 148 extending outwardly from the bottom of the rim. The pedestal rests on the flange 148 and against the rim 146.

A pair of rails 102 and 104 are disposed on, and are raised slightly above, a top surface 101 of the base 100. The rails 102 and 104 appear as embossed protuberances lying substantially parallel to opposite edges of the base 100. They cooperate with cradles 106 and 108 to hold a pair of batteries in place on the top surface 101 of the base 100. The cradles 106 and 108 are also generally parallel to each other and to opposite edges of base 100, but are generally at right angles (perpendicular) to the rails 102 and 104.

Parallel to, and respectively adjacent, cradles 106 and 108, are a pair of pylons 110 and 114. The pylon 110 provides support for an electrical conductor 112 which serves to interconnect the pair of batteries disposed on the cradles. The cradle 106 includes a cutout 107 which is substantially identical and parallel to a cutout 109 in cradle 108. A battery disposed in the cutouts 107 and 109 and against rail 102 makes electrical contact with conductor 112 at one end and with a conductor 116 supported by pylon 114 at its opposite end.

Cradles 106 and 108 include other cutouts corresponding to cutouts 107 and 109 for another battery which is supported by the other cutouts and by the rail 104. One end of the other battery also makes contact with conductor 112. The opposite end of that battery makes contact with another conductor 118 supported by pylon 114.

In the center of the base 100 is a circular depression 120 which extends downwardly from the top surface 101. An aperture 122 extends through the base 100 from the center of depression 120. Another pylon 124 extends upwardly from depression 120 and serves as a support for portions of the electrical circuitry, including lamp 126. A web 128 extends from pylon 114 to pylon 124.

The conductor 116 includes a spring portion 130 which is biased outwardly from pylon 114 to its inherent spring characteristics. The spring portion 130 makes contact with a battery extending between it and the conductor 112. From the spring contact portion 130, conductor 116 is disposed against and secured to the pylon 114, web 128, and web 124, and it terminates adjacent web 124 in a switch contact 132.

Conductor 118 includes a spring contact portion 134 which is disposed outwardly from pylon 114 and makes contact with a terminal of a battery extending between it and the conductor 118. Conductor 118 terminates on web 128 underneath, and in electrical contact with a conductor 136. Conductor 136 extends and is secured to the pylon 124 and terminates above the pylon in a base contact 138 which electrically interconnects with the base of lamp 126.

A conductor 140 is secured to a side of pylon 124 and extends upwardly against and above the pylon from depression 120 and terminates in a flange 142 which is substantially parallel to base 100. The flange 142 includes an aperture extending therethrough into which the threaded portion of lamp 126 extends. Thus the lamp makes electrical contact with flange 142 of conductor 140 and with base contact 138 of conductor 136. The switch contact 132 of conductor 114 is spring biased against conductor 140 to make electrical contact therewith. The lamp 126 makes electrical contact with conductor 116 through switch contact 132 and conductor 140, and with conductor 118 through base contact 138 and conductor 128.

A rotal base 150 extends beneath the base 100. The rotal base provides the function of supporting the base, pedestal, and viewing and diffuser cubes and also the function of actuating the switch apparatus to make and break, or connect and disconnect, the electrical connections or circuitry associated with the lamp. The rotal base 150 includes a base plate 152 which is generally circular in configuration. On the exterior periphery of the base plate is an upwardly extending rim 154.

Beneath the base plate 152 is a layer of friction material 156, which may be any appropriate substance, such as cork. When a user moves the assembled base, pedestal, and viewing cube about the rotal base, the friction material 156 allows the rotal base 150 to remain in position during the rotation of the rest of the apparatus.

Extending upwardly from the center of the rotal base 150 is a cam 160, which is in the configuration of a fluted cone. The flutes or lobes of the cam 160 provide the camming surfaces against which switch contact 132 moves to make and break contact with conductor 140. The cam 160 includes a neck 162 of reduced diameter adjacent base plate 152. The neck 162 extends through the aperture 122 of base 100. The diameter of aperture 122 is slightly greater than the diameter of the neck 162 thus allowing the base 100, with the pedestal and the cube secured thereto, to rotate freely about the rotal base 150. Neck 162 is also of a length which is greater than the thickness of circular depression 120 of the base 100, thus allowing the base, with the pedestal and viewing cube secrued thereto, to move up and down, axially, along neck 162.

As previously indicated, the configurations of cam 160 is that of a fluted cone. The portion of largest diameter of the cam 160 is adjacent the neck 162 and the diameter tapers inwardly to the rather bluntly pointed top of the cam. The cam includes four lobes or flutes 164, 165, 166, and 167 (see FIGS. 8 and 9) which extend outwardly and downwardly from the top of the cam to the area of largest diameter adjacent the neck 162. Between the flutes, or camming surfaces of greatest radius, are concave troughs or valleys, which comprise camming surfaces of minimum radius. Thus the appearance of the cam 160 is somewhat like a cam surface of constantly changing radius from a minimum radius at the top to a maximum radius at the bottom, and with a varying radius circumferentially or horizontally. Because of the configuration of the cam, it provides both vertical and horizontal camming surfaces.

When the base 100 is disposed on the rotal base 150, the switch contact 132 is disposed against cam 160. As the base 100 is moved by horizontal rotation on the rotal base 150, the switch contact 132 is moved or cammed radially inwardly and outwardly by the camming surfaces of the cam 160. When the spring contact is against one of the flutes 164, etc., the electrical connection or circuit between the switch contact 132 and the conductor 140 is broken (opened). As the base 100 moves such that the switch contact 132 moves into one of the concave areas or valley portions of the cam, the switch contact 132 is electrically connected to the conductor 140 to complete (close) the circuit. In the alternative, with the diameter of the cam 160 decreasing towards the top, the vertical movement by the lifting of base 100 on the rotal base 160 also actuates the switch. As the base is moved vertically on the neck portion 162 of the rotal base, the switch contact 132 moves upwardly and radially inwardly to an area on the cam 160 at which the diameter or radius is sufficiently small to allow the switch contact to make an electrical connection with the conductor 140 to thus close or complete the circuit. Thus the circuit may be completed by alternate vertical and rotary motion.

When the circuit is closed or completed, the lamp 126 is turned on to illuminate the slides or transparencies held between the viewing cube 70 and the diffuser cube 80. The conical fluted cam accordingly provides two ways for completing and for opening the electrical circuit: rotation and vertical movement. Rotation in either direction will result in the circuit opening and further rotation will result in the circuit closing. With four flutes or lobes to the cam 160, a complete 360° rotation of the base 100 about the rotal base 150 will result in the lamp 126 being turned on four times and turned off four times. Upward vertical movement of the base 100 with respect to the rotal base 150 will result in the lamp 126 being turned on regardless of the position of the switch contact 132 on the conical fluted cam 160. However, if the switch contact 132 were in a depression or valley portion of the cam so as to close the circuit with the base 100 in the lower or rest position on the rotal base 150, the base 100 would have to be rotated relative to the rotal base 150 to open the circuit (turn "off" the lamp) when the base 100 is moved vertically downwardly relative to the rotal base 100. Obviously, if the lamp is "on" when the base 100 is in the lower (down) or rest position relative to the rotal base 150, the lamp will remain on when the base 100 is moved upwardly with respect to the rotal base 150.

FIG. 6 is a view of the apparatus of FIG. 5 taken generally along line 6—6 of FIG. 5. It comprises a view in partial section of the apparatus of FIG. 5 assembled together. From the bottom of the apparatus upwardly, the rotal base 150 is shown, with its friction material 156 being secured to the bottom of base plate 152. Rim 154 extends upwardly from the exterior periphery of the base plate 152, and cam 160 extends upwardly from the center of the rotal base 150. The neck 162 of the cam 60 extends through aperture 122 which is centered within the circular depression 120 of the base 100. The base 100 is thus centrally located and disposed on the rotal base 150, and supported on the base plate 152 of the rotal base.

Pedestal 90 is in turn disposed on flange 148 of base 100, with the sides 92 of the pedestal secured against rim 146 of the base. Within the pedestal 90, and disposed on the top surface 101 of the base 100, are pylons 110 and 114, which support respectively conductors 112 and 116. The conductors provide electrical contact for batteries, not shown, which are supported between the conductors by battery cradles 106 and 108. Conductor 116, while supported by pylon 114, also is supported against center web 128, which extends between pylon 114 and the center pylon 124. Conductor 116 includes a switch contact 132 which is biased against the cam 160. As the base 100, with the pedestal 90 secured thereto, is either moved vertically or is rotated, the switch contact makes and breaks electrical contact with conductor 140. Conductor 140 extends upwardly through aperture 96 in the top 94 of pedestal 90 and into the interior of diffuser cube 80 and viewing cube 70. The conductor 140 includes a flange 142 which receives lamp 126. Base contact 138 makes contact with the base of lamp 126 and with another conductor to complete the electrical circuitry.

Viewing cube 70 is received in recess 99 in the top 94 of pedestal 90. Between the diffuser cube 80 and the viewing cube 70 are slides 74, 75 and 76. When lamp 126 is illuminated by the interconnection or completion of the electrical circuitry, the light from lamp 126 is diffused by the diffuser cube 80 so as to provide relatively even illumination through each of the slides for maximum viewing through the cube 70.

FIG. 7 is a vertical plan view of the apparatus of FIG. 5 taken generally along lines 7—7 of FIG. 5, and it shows the relative placement of the components disposed on the top surface 101 of base 100. A pair of batteries 170 and 172 are shown in phantom supported respectively between battery cradles 106 and 108 and side rail 102, and battery cradle 106, battery cradle 111, and side rail 104. Cradle 106 is continuous, although it includes a pair of cut-out portions, one for each battery, as it extends between the batteries, but cradles 108 and 111 are not continuous, since there is a web 128 separating them. The web 128 extends between pylon 114 and center pylon 124.

The battery 170 is electrically connected to, and it extends between, conductor 112 and the spring contact portion 130 of conductor 116. Conductor 116 extends from the battery, adjacent the pylon 114 and web 128, to terminate in switch contact 132 adjacent conductor 140 which is secured to the pylon 124.

Cam 160 extends through an aperture in circular depression 120 of the base 100 and provides camming surfaces for moving switch contact 132 into and out of electrical contact with conductor 140 as the base 100 moves relative to the cam secured to the rotal base. The cam 160, as explained above, is secured to a relatively stationary rotal base, and relative movement, both vertical and rotational, between the rotal base and base 100 results in movement of the switch contact 132 relative to the cam 160 to make and break contact between the conductor 116, through its switch contact 132, and the conductor 140.

Conductor 112, supported by pylon 110, provides electrical contact between battery 170 and battery 172. The battery 172 is substantially parallel to battery 170 and it is disposed on the top surface 101 of base 100 between cradle 106, cradle 111, and rail 104. The cradle 111 extends outwardly from web 128. The end of battery 172 opposite that end which contacts conductor 112 is connected to conductor 118 through its spring contact portion 134. The conductor 118 is supported by, and connected to, pylon 114 and web 128. It terminates underneath conductor 136. Conductor 136 extends to center pylon 124, which it is also disposed against and secured to, and from pylon 124 it makes contact with the base of the lamp, as shown in FIGS. 5 and 6.

FIGS. 8 and 9 illustrate the making and breaking of electrical contact between spring contact 132 of conductor 116 and conductor 140 as relative motion between cam 160 and conductor 116 takes place. In FIG. 4 the four cam lobes 164, 165, 166, and 167 are illustrated, with a portion of switch contact 132 disposed on the high spot of cam 166. With the conductor on the high part of the cam, electrical contact is broken between the conductor 140 and the switch contact 132.

In FIG. 9, relative motion between the cam 160 and the conductor 116 has displaced the conductor away from the high spot of the cam, allowing switch contact 132 to make electrical contact with conductor 140.

When the base 100 (see FIGS. 5, 6, and 7) is lifted on the rotal base 150 (see FIGS. 5 and 6), the switch contact 132 is moved upwardly on cam 160, and the decreasing radius of the cam surface allows electrical contact to be made between switch contact 132 and conductor 140 regardless of the position of the lobes of cam 160.

FIG. 9 is a schematic representation of the electrical conductors which comprise the circuitry of the embodiment of FIG. 5. Assuming a source of electrical current, such as batteries, as shown by dotted lines A and B in FIG. 10, the conductor 112 extends between the two to connect the batteries at one of their respective ends. The conductor 112 includes a pair of spring contact portions at its outer extremities, which are not identified specifically, as are the spring contact portions 130 and 134 of conductors 116 and 118, respectively. The conductor 112 is well known in the art and comprises a single conductor which electrically interconnects a pair of batteries which are disposed parallel to each other. The ends of the batteries, opposite from the ends which electrically contact conductor 112, respectively make contact with conductors 116 and 118, at their spring contact portions 130 and 134. From spring contact 130, conductor 116 extends to, and terminates in, a switch contact 132 which is disposed at substantially a right angle to, and makes electrical contact with, conductor 140. Conductor 140 extends generally vertically and terminates in a flange 142. The flange includes an aperture 144 which receives the base of a lamp, such as shown in FIGS. 5 and 6. The lamp is screwed into the aperture 144 and makes electrical contact therewith. At the lower end of the lamp and electrically connected thereto is base contact 138 which is a part of conductor 136. Conductor 136 is an electrical contact with the conductor 118, which extends from beneath the conductor 136 to terminate in the spring contact 134. Contact 134 in turn makes electrical connection with one end of a battery, as shown by line A to complete the circuit. The switching is accomplished by the camming action of switch contact 132 away from and against conductor 140, as has been explained in detail above.

Connector 136 is inherently spring biased downwardly against conductor 118 to make electrical contact therewith. If a source of electrical energy other than batteries is desired, such source may be connected directly to conductor 136 and to web portion 117 of conductor 116 as by use of an external plug. When prongs of a plug (not shown) are inserted within the pedestal, a prong disengages conductor 136 from electrical contact with conductor 116 as by use of an external plug. When prongs of a plug (not shown) are inserted within the pedestal, a prong disengages conductor 136 from electrical contact with conductor 116, thus effectively disconecting the batteries from the circuit. This allows an electrical source to be connected directly to the circuit without going through the batteries. When the external plug is removed the batteries are reconnected when conductor 136 again contacts conductor 118.

FIG. 11 discloses an alternate embodiment of cam 160, which may be used when the rotal base is not desired. A cam 180 may be used in place of cam 160 when the apparatus is used without the rotal base. The lifting of base 100 (see FIGS. 5, 6, and 7), without the rotal base and by using cam 180 rather than cam 160, results in movement of the cam 180 downwardly and away from switch contact 132 to allow the switch contact to make electrical connection against conductor 140. The cam 180 includes a conical portion 182, an upper cylindrical portion 184 which is of substantially constant diameter, a neck portion 186, and a lower cylindrical portion 188. The neck portion 186 is a portion of reduced diameter extending between the cylindrical portions 184 and 188. Above cylindrical portion 184, the conical portion 182 tapers inwardly and upwardly to a point. With the neck 186 of the cam 180 extending through aperture 122 of base 100 (see FIGS. 5 and 6), the switch contact 132 is disposed against the upper cylindrical portion 184 of the cam 180 providing the apparatus is disposed on a flat surface so that the bottom of lower clindrical portion 188 of the cam is against such surface. That is, in a position of rest, cam 180 is disposed on a surface and is biased upwardly by the surface a distance sufficient to result in the switch contact 132 being cammed away from conductor 140 by the cylindrical surface 184. When the apparatus is moved, such as lifted or tilted, the cam 180 moves by gravity downwardly and the neck portion 186 moves downwardly through the aperture 122 of the base. The diameters of cylindrical portions 184 and 186 are greater than the diameter of aperture 122 and accordingly the upper cylindrical portion 184 drops down until its underneath side is disposed on the circular depression 120 of base 100 (see FIG. 5). The switch contact 132 is then moved away from the upper cylindrical portion 184 and against the reduced diameter of the conical portion 182 of the cam to allow the switch contact to bear against conductor 140 to complete the electrical circuit.

When the apparatus is once again disposed on a flat surface, the lower cylindrical portion 188 of the cam 180 contacts the surface and moves the cam relative to the switch contact which causes the switch contact to be cammed off the conical portion 182 and thus out of electrical contact with conductor 140. The switch contact then bears against upper cylindrical portion 184 of the cam and out of electrical engagement with the conductor.

There has been herein disclosed novel viewing apparatus in which electrical connection is accomplished by vertical and rotary relative motion between the various portions of the viewing apparatus to make and break electrical connections. The embodiments include various features of switching apparatus, depending on the orientation of the apparatus, to cause a lamp to be illuminated. If desired, the apparatus may be used either as display apparatus or as an illuminated call signal.

Figure 12:
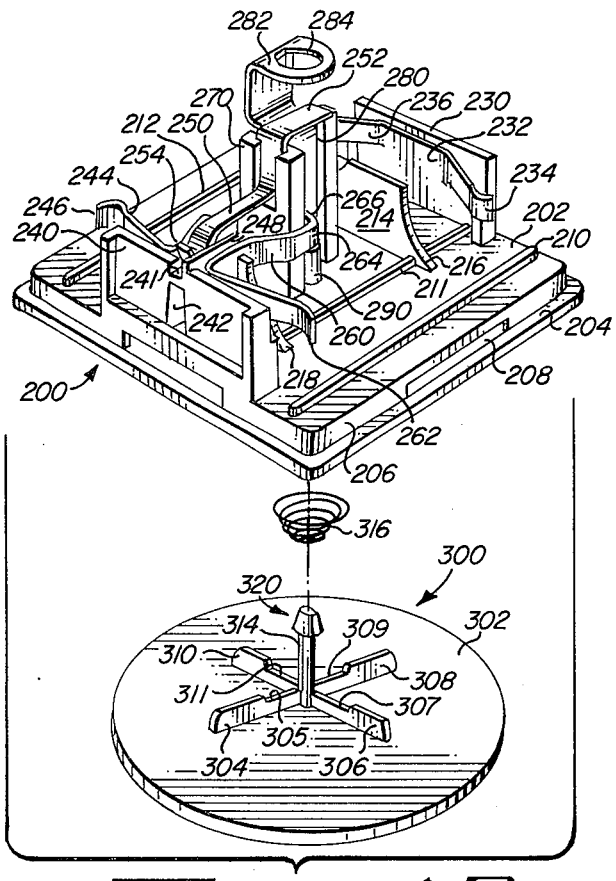
FIG. 12 is a partially exploded isometric view of an alternate embodiment of the apparatus of the present invention.

FIG. 12 is an exploded perspective view of an alternate embodiment of the present invention. The embodiment includes a base 200 which is similar to the base 100 of the embodiment of FIGS. 5–7. However, there are slight differences between the two types of bases. The base 200 is of a generally square configuration which includes a top surface 202 on which are disposed the electrical circuitry and the necessary support members for the circuitry. The circuitry is similar to the circuitry of the embodiment of FIGS. 5–10.

The base 200 includes a ledge 204 which comprises an outwardly extending flange about the periphery of the base and downwardly and outwardly from the top surface 202. The ledge 204 is connected to the top surface 202 by downwardly depending sides 206. The sides 206 are substantially perpendicular to the top 202, and the ledge 204 is substantially perpendicular to the sides 206. Within each side 206 is a recess 208 which receives a protuberance to frictionally hold the base 200 to a pedestal, such as the pedestal 10 of FIG. 1 or the pedestal 90 of FIG. 5, to the base. In the embodiments of FIGS. 1–10, the pedestal is held onto the base in a different manner. The holding provision, as illustrated in FIG. 11, of providing a recess to allow the bottom portion of a pedestal to have a protuberance which fits into the recess, is merely an alternate method of frictionally holding a pedestal to the base. Obviously, any type of frictional engagement may be used. In the present embodiment, a pedestal is received on the ledge 204 and is held therein by a protuberance on the inside periphery of the pedestal which frictionally engages and receives the recesses 208 on all of the sides 206 of the base 200.

Disposed on the top 202 of the base 200 are a pair of outside rails 210 and 212. The rails are parallel to each other and are disposed inwardly from opposite sides of the top of the base. The rails cooperate with a pair of inside rails, of which only inside rail 211 is shown in FIG. 12. A battery (not shown) is disposed between rails 210 and 211, and another battery (also not shown) is disposed between rail 212 and its inside rail, which is not shown in FIG. 12. The rails also cooperate with cutout portions of cradles which are disposed substantially perpendicular to the rails. A cradle 214 is shown with a cutout 216 adjacent the rails 210 and 211. Parallel to the cradle 214 and spaced apart therefrom on the opposite side of the top of the base is another cradle with a cutout 218 which is substantially parallel to the cutout 216. A battery is received between the rails 210 and 211 and against or within the cutouts 216 and 218. Another battery is disposed substantially parallel at the opposite side of the top 202 of the base 200 against the rail 212 and its parallel rails and a pair of cutouts similar to cutouts 216 and 218.

The batteries disposed in the cutout portions of the cradles and within the rails are electrically interconnected with each other and also with a lamp by electrical circuitry similar to that shown in detail in FIGS. 5–10. Perpendicular to the batteries and to the rails is a pylon 230 against which is disposed a conductor 232. The conductor 232 includes a pair of spring contacts 234 and 236 which make electrical contact with one end of each of the batteries disposed on the top 202.

Parallel to the pylon 230 at an opposite side of the base 200 is another pylon 240 on which are disposed other conductors for completing the electrical circuitry. The pylon 230 includes an upper notch 241 which extends downwardly from the top of the pylon, and another notch, lower notch 242, which is disposed beneath the notch 241. Upper notch 241 and lower notch 242 may receive a plug from an exterior power source if a power source other than the battery is desired for the apparatus.

A conductor 244 is disposed on one side of the notches 241 and 242 and is secured to the pylon 240. The conductor 244 includes a spring contact portion 246 which is substantially parallel to the spring contact 236. The spring contact 246 makes electrical contact with the opposite end of the battery. The conductor 244 is disposed against the pylon 240 and against a transverse web 248 which extends inwardly, or towards a center pylon 270, from the pylon 240 on one side of the notches 241 and 242. The conductor 244 extends along the web 248 as well as along the web 240 and the conductor terminates between the web 248 and the center pylon 270.

A conductor 250 is secured to the upper portion of the center pylon 270 and one end of the conductor terminates in a switch contact 252 disposed within the upper notch 241 and the opposite end of the conductor 250 terminates in a base contact 252 above the center pylon 270. The conductor 250 is inherently spring biased downwardly into electrical contact with the conductor 244. However, if an exterior power source plug is inserted into the notches 241 and 242, the electrical contact from the plug biases the switch contact 254 upwardly and away from electrical contact with the conductor 244, thus breaking the internal battery circuit.

Another elelectrical conductor 260 is disposed also against plyon 40 and against the web 248 on the opposite side of the pylon and the web from the conductor 244. Conductor 260 includes a spring contact 262 disposed oppositely from the spring contact 234 and makes electrical contact with a battery disposed between rails 210 and 211 and within the cutouts 216 and 218. The spring contacts 234 and 262 accordingly make electrical contact with opposite ends of such battery.

The lower notch 242 provides access to the conductor 260 for an external power source. While one contact from an external power plug makes electrical connection with contact 254, another contact from the external power plug makes electrical connection with conductor 260 through lower notch 242.

The conductor 260 also includes a cam following portion 264 which is disposed along one side of the center pylon 270 and it terminates in a switch contact 266 which makes electrical contact with a conductor 280 disposed along and vertically extending on the center pylon 270.

The conductor 280 extends vertically along one side of the center pylon 270 and terminates above the pylon in a flange 282 which is substantially parallel to the top surface 202 of the base 200. The flange 282 includes an aperture 284 which receives the base of a light bulb or lamp. The flange 282 accordingly makes contact with one portion of the base of a lamp and the base contact 252 makes electrical contact with the center electrical connection of such lamp. The cam following portion 264 of the conductor 260 contacts a cam disposed in a cylindrical pylon 290 which extends upwardly from the center portion of the base 200 and adjacent the conductor 280 on the center pylon 270. As the cam following portion 264 is moved by a cam outwardly with respect to the conductor 282, the switch contact 262 moves away from the conductor 280 to break the electrical connection therewith. As the cam rotates within the cylindrical pylon 290, the inherent flexibility or spring of the conductor 260 causes the switch contact portion 266 to be biased into electrical contact with the conductor 280, thus connecting the electrical circuitry, which is substantially similar to the switching of the electrical circuitry as described above in connection with FIGS. 5–10.

In FIG. 11 a rotal base 300 is shown disposed beneath the base 200, and separated slightly therefrom. The rotal base 300 is circular in configuration. Four braces, braces 304, 306, 308, and 310 are disposed on a top 302 of the rotal base 300. The braces are centered on the rotal top and are disposed at 90° from each other. The braces 304 . . . 310 extend radially outwardly from a center post 314 which extends upwardly, substantially perpendicularly, to the top 302 of the rotal base 300. Adjacent the post 314 on each of the braces is a relieved portion which extends downwardly from the upper part of each brace. Brace 304 includes relieved portion 305, brace 306 includes relieved portion 307, brace 308 incudes relieved portion 309, and brace 310 includes relieved portion 311. The relieved portions receive a spiral compression spring 316 when the rotal base 300 is connected with the base 200. The spiral compression spring 316 is shown in FIG. 12 between the rotal base 300 and the base 200. When the apparatus is assembled, the spring 316 fits coaxially over the post 314 and provides a bias between the rotal base 300 and the base 200, as will be described in detail below. When the apparatus is assembled together, the coils of the spring 316 are compressed together and are received into the relieved portions of the braces.

At the top of the post 314 is a cam 320. The cam 320 is in the form of an elongated or elliptical truncated cone, with the lowermost portion of the cam defining a somewhat rather narrow but cutoff-at-the-ends elliptical cross section, tapering upwardly and inwardly to a smaller elliptical cross section with blunt or square ends, similar to the lower portion of the cam. As illustrated in FIG. 12, and illustrated in more detail in FIGS. 13–16, the cam includes a pair of cam lobes, comprising the square or cutoff ends of the cam which bear against the cam follower portion 264 of conductor 260 to move the switch contact 266 out of engagement with the conductor 280. When the major axis of the cam, which comprises the axis between the ends of the cam, bears against the cam following portion 264 of the conductor 260, the contact 266 is moved away from conductor 280. When the base 200 is rotated with respect to the rotal base 300 so as to move the cam following portion 264 of the conductor 260 away from the blunt ends of the cam, the inherent spring bias of the conductor 260 causes it to move into electrical contact with the switch contact 266 against the conductor 280 to complete the electrical circuit between the batteries and the lamp or bulb disposed within aperture 284 and also against base contact 252.

Figure 13:
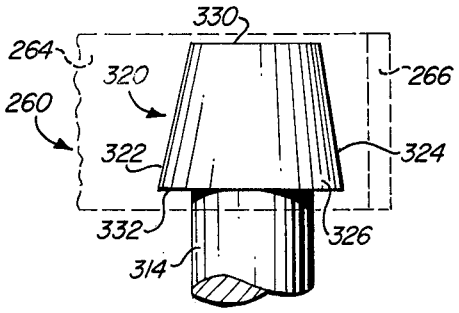
FIG. 13 is an enlarged side view of a portion of the apparatus of FIG. 12.

FIG. 13 is an enlarged view of a portion of the apparatus of FIG. 12, comprising an illustration of post 314 and cam 320. The cam 320 is disposed on the top of the post 314. The cam includes a pair of relatively flat ends 322 and 324, and a pair of curved sides which extend between the flat ends. One side, side 326, is shown in FIG. 13. The cam also includes a top surface 330, which is relatively flat, and a bottom surface 332 which is disposed about the post 314.

The cam is generally in the form of an upwardly and inwardly tapering elliptically shaped cone. The relatively flat or planar ends 322 and 324 are rather narrow, and the distance between them defines the major axis of an ellipse, while the curved sides, such as side 326, which extend between the ends, are narrower in width or in distance, and accordingly the minor axis of the ellipse is defined as the distance between the sides. The major axis of the elliptically configured cam is greatest adjacent the bottom 332 and is least adjacent the top 330, and the minor axis is similarly varied, decreasing upwardly from the bottom 332 to the top 330. Accordingly, the elliptically shaped cam is conical, or rather is a truncated cone in that the elliptical cone is cut by a pair of parallel planes, defining the bottom 332 and the top 330. The top 330 and the bottom 332 are preferably perpendicular to the axis of the post 314.

In FIG. 13, a portion of the cam follower 262 of the conductor 260 (see FIG. 12) is shown in phantom adjacent the cam 320 and the post 314. The switch contact portion 266 of the conductor 260 is also shown in phantom in FIG. 13.

Figure 14:
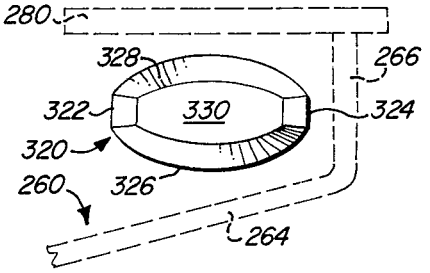
FIG. 14 is an enlarged top view of the apparatus of FIG. 13.

FIG. 14 comprises an enlarged top view of the apparatus of FIG. 13. The cam 320 is shown from the top (above), disposed between the conductor 280 and the cam following portion 264 of conductor 260. The switch contact portion 266 of the conductor 260 is shown in electrical contact with the conductor 280. The conductor 280 and conductor 260 are both shown in phantom.

The generally elliptical configuration of the cam 320 is clearly shown in FIG. 14. The top portion 330 of the cam is shown as the smallest portion of the cam, with the curved sides 326 and 328 extending downwardly from the top 330 and extending transversely respectively to the flat end portions 322 and 324. In other words, the sides and ends extend between the top and bottom, and taper inwardly and upwardly to define camming surfaces for both vertical and rotary movement.

With the cam 320 in the position shown in FIG. 14, the cam is not touching the cam following portion 264 of the conductor 260, and accordingly the inherent spring bias of the conductor results in electrical contact between the conductor 260 and the conductor 280. This electrical contact completes or makes the circuit, shown in more detail in FIG. 12, to allow an appropriate source of electrical energy to be connected with a lamp, as discussed above.

Figure 15:
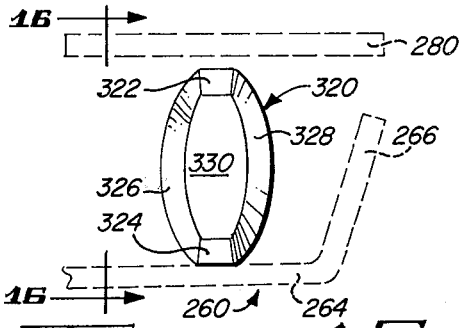
FIG. 15 is an enlarged top view of the apparatus of FIG. 14, illustrating the sequential movement of the apparatus.

FIG. 15 is an enlarged top view of the apparatus of FIG. 14, illustrating the sequential movement of the cam 320. Conductors 260 and 280 are shown in phantom in FIG. 15, just as in FIGS. 13 and 14. In FIG. 15, the cam 320 has been rotated ninety degrees from that shown in FIG. 14 and accordingly a portion of flat end 324 is shown disposed against the cam following portion 264 of the conductor 260. When the cam follower portion 264 contacts the cam 320, the cam, during its rotation, moves the switch conact 266 of the conductor out of electrical contact with the conductor 280, thus breaking or opening the circuit which results in the turning off of the lamp, as discussed above.

Since the cam 320 is of a generally elliptical configuration, with relatively narrow ends 322 and 324, the degree of dwell of the cam following portion 264 on either of the ends is a relatively small amount of time or a relatively few degrees of rotation as compared with the relatively large angular portion of the sides 326 and 328 of the cam 320. This of course means that the cam must be rotated nearly 180° relative to the cam follower portion 264 of the conductor 280 before the light is turned off by breaking or opening the circuit. Obviously, the cam 320 may be configured in a different manner if a different angular rotation is desired to turn on and to turn off a lamp. The relative length of the sides 326 and 328 provides for a relatively long turned on period, rotation wise.

The generally flat end portions 322 and 324 provide a positive area of contact between the cam and the conductor 266. With the spring bias inherent in the conductor, the conductor tends to move into engagement with the entire width of the flat end once contact with either of the sides 326 and 328 is lost and to remain in such contact until sufficient relative movement between the cam and the conductor has occurred to move the conductor out of engagement with a flat end and into engagement with a side.

Figure 16:
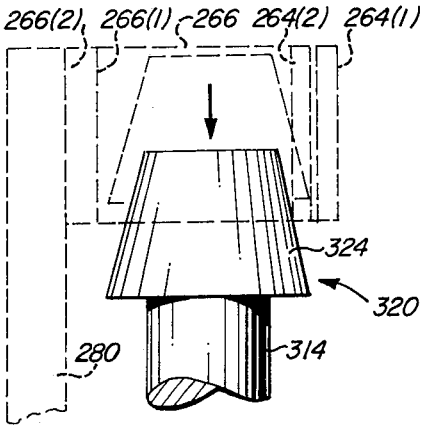
FIG. 16 is an enlarged side view of the apparatus of FIG. 13 illustrating a sequential movement of a portion of the apparatus.

FIG. 16 is an enlarged side view of the apparatus of FIG. 15, taken generally along line 16—16 thereof, illustrating the sequential vertical movement of the cam 320 with respect to the conductor 260 and the conductor 280.

The cam 320, secured to the top of the post 314, is shown in phantom at its uppermost position with respect to the conductor 280 and the switch contact portion 266 of conductor 264. At the uppermost position of the cam 320, the end 324 of the cam is shown disposed against the cam follower portion 264, thus preventing the electrical contact between the switch contact 266 and the conductor 280. This particular disposition or arrangment of the respective conductors and the cam is shown in FIG. 15 in the top view. In FIG. 16, the initial orientation of the cam 320, its end 324, the cam follower portion 264 of conductor 260, and the switch contact portion 266 of conductor 260 is indicated by the parenthetical numeral 1 beside reference numerals 264 and 266. Thus, the position of cam follower 264(1) against the end 324 of cam 320 prevents electrical contact between the conductor 280 and the switch contact 266(1) to prevent the circuit from being closed.

When the base 200 (see FIG. 12) is moved upwardly with respect to the rotal base 300, the cam 320 is moved relatively downwardly with respect to the cam follower portion 264 and the inherent spring bias in conductor 260, of which the cam following portion 264 is a part, and the conductor accordingly moves its switch contact portion 266(2) into electrical contact with conductor 280. The cam follower portion 264(2) accordingly moves also to the position indicated in FIG. 16. Thus regardless of the position of cam 320 with respect to the cam follower portion 264, when motion occurs in the vertical sense between the base 200 and the rotal base 300, the electrical circuit is completed in the apparatus and the lamp is illuminated. If the lamp is already illuminated prior to the vertical relative movement. Indicating that electrical contact is made between the switch contact 266 and the conductor 280, as illustrated in FIG. 14, the vertical relative movement will have no effect on the circuitry.

Referring again to FIG. 16, when the relative movement between the base and the rotal base, or with respect to the cam 320 and the cam follower portion 264 of the conductor 260 (see FIG. 15) is reversed, resulting in the upward movement of the cam 320 with respect to the cam follower portion 264, the cam follower portion is again biased outwardly on the end 324 of the cam 320 to once again break the electrical contact between the switch contact portion 266 and the conductor 280 to turn off the lamp.

Figure 17:
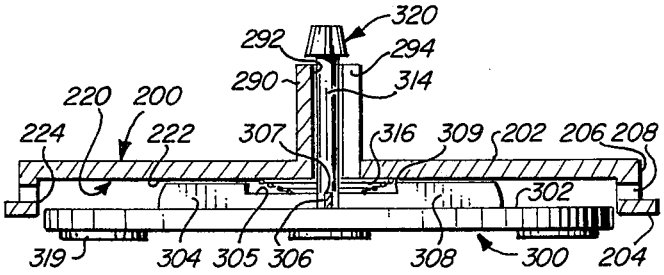
FIG. 17 is an enlarged view in partial section of a portion of the apparatus of FIG. 12.

FIG. 17 is an enlarged view in partial section of a portion of the apparatus of FIG. 12, illustrating the assembly of the base 200 and the rotal base 300. The base 200 is shown in partial section disposed over the rotal base 300.

With respect to the base 200, only the center pylon 290 is shown, and the electrical circuitry and pylons associated therewith have been omitted for purposes of clarity of illustration. Two of the sides 206 are shown extending downwardly from the top 202 of the base 200, and the outwardly extending flanges or ledges 204 are also shown extending outwardly from the sides 206. The recesses 208 are shown extending through the sides 206.

On the inside of the sides 206 and beneath the top 202 is an underneath recess or chamber 220, into which is disposed the rotal base 300.

The chamber 220 is defined by a bottom or underneath side 222 of the base 200 and inside interior walls 224 of the sides 206. Within the chamber 220 is located the rotal base 300, which may be disposed on any flat surface and rests thereon on pads of frictional material 316. The frictional pads 316 provide sufficient friction to allow the rotal base 300 to remain in position as the base 200 is rotated, with the pedestal and viewing cube secured thereto, to turn on and turn off the lamp to illuminate, as desired, the transparencies or slides in the cubes.

Post 314 of the rotal base 300 extends upwardly through the cylindrical pylon 290 which is disposed centrally with respect to the base 200. The interior of the cylindrical pylon 290 comprises an enongated sleeve 292 through which the post 314 extends. The interior diameter of the sleeve 292 is less than the major diameter of the cam 320 and accordingly, once the cam and the post are inserted through the sleeve and the cylindrical pylon, the base 200 and the rotal base 300 are secured together. The cylindrical pylon 290 includes a relatively narrow slot 294 which communicates with the interior sleeve 292 to allow the cam 320 and the post 314 to be inserted in the cylindrical pylon 290. The slot 294 extends downwardly from the top of the cylindrical pylon 290 to the underneath of the base 200, including through the top 202 down to the underneath chamber 220. The width of the slot 294 is slightly larger than the diameter of the post 314, which is substantially the same as the minor diameter of the elliptical cam 320 (see FIGS. 14 and 15).

The bottom or underneath surface 322, which comprises the top surface of the chamber 220, rests, or is disposed on, the upper surfaces of the respective braces 304 . . . 310, of which braces 304 and 308 are shown in side view in FIG. 17, and brace 306 is shown in partial section. The spiral compression spring 316 is shown compressed beneath the underneath or bottom side 222 and within the relieved portions 305 . . . 311 of the braces. In FIG. 17, the relieved portions 305, 307, and 309 are clearly illustrated. The spiral compression spring 316 provides a bias between the rotal base 300 and the base 200 to urge the separation between the two bases. This bais enhances the relative rotation between the base 200 and the rotal base 300 by preventing the entire weight of the base 200, with its accessories disposed on and secured thereto, from resting on the upper portions of the braces.

Figure 18:
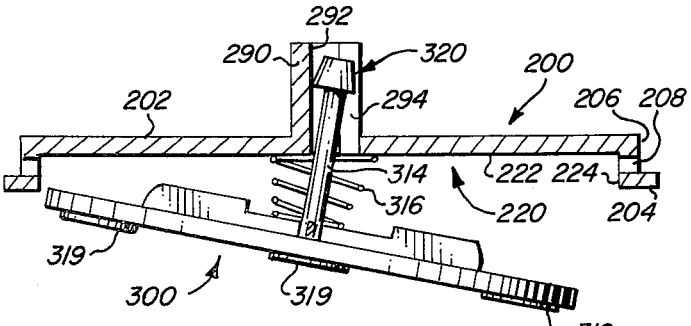
FIG. 18 is an enlarged view in partial section of the apparatus of FIG. 17 illustrating a sequential movement of the apparatus.

FIG. 18 is an enlarged view in partial section of the apparatus of FIG. 17 illustrating a sequential movement of the apparatus with respect to either the separation or the installation of the rotal base 300 and the base 200.

As stated above, the diameter of the sleeve 292 is slightly greater than the diameter of the post 314, and also the width of the slot 294 of the cylindricll pylon 290 is substantially the same, slightly larger, than the diameter of the post 314. The diameter of the post 314 is also the same as the minor diameter or width of the cam 320. However, the combined diameter of the sleeve 292 and the length of the slot 294, which length is the thickness (outside diameter less the inside diameter) of the cylindrical pylon 290, is slightly less than the major diameter or length of the cam 320. Accordingly, in installing or separating the rotal base 300 and the base 200, the rotal base 300 must be tipped at an angle, as illustrated in FIG. 18, so as to minimize the overall length of the cam 320 with respect to the sleeve 292 and the slot 294 as the cam passes through the base 200 between the upper surface 202 and the underneath side 222 of the base.

The spiral compression spring 316 is shown disposed about the post 314 in an expanded configuration, urging the separation of the rotal base from the base.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Display apparatus, comprising, in combination:
rotal base means;
viewing case means disposed on the rotal base means and movable relative to the rotal base means;
electrical circuitry means for illuminating the viewing case means including a lamp disposed in the viewing case means; and
switch means attached to the viewing case means for connecting and disconnecting the electrical circuitry in response to the relative movement of the rotal base means and the viewing case means, including means for providing alternate vertical and rotary movement of the switch means in response to the relative motion of the rotal base means and the viewing case means.

2. The apparatus of claim 1 in which the switch means includes cam means having vertical and horizontal camming surfaces for connecting and disconnecting the electrical circuitry in response to the vertical and the rotary movement.

3. The apparatus of claim 2 in which the cam means are secured to the rotal base mans and the switch means further includes contact means secured to the viewing case means.

4. The apparatus of claim 3 in which the cam means includes a conical fluted cam surface and the contact means is movable on the cam means to connect and disconnect the electrical circuitry.

5. The apparatus of claim 2 in which the cam means is secured to the rotal base means.

6. The apparatus of claim 5 in which the cam means includes a concave depression providing vertical and horizontal camming surfaces.

7. The apparatus of claim 6 in which the switch means further includes contact means and said contact means includes a pin movable into and out of the concave depression of the cam means.

8. The apparatus of claim 2 in which the cam means is of a generally elliptical cross section.

9. The apparatus of claim 8 in which the cam means includes a top, a bottom, a pair of relatively flat and narrow ends extending between the top and the bottom, and a pair of curved sides extending between the ends and between the top and the bottom.

10. The apparatus of claim 9 in which the ends and the sides taper inwardly and upwardly from the bottom to the top.

* * * * *